US005881382A

United States Patent [19]

Bernard et al.

[11] Patent Number: 5,881,382

[45] Date of Patent: Mar. 16, 1999

[54] PLACE-ON BIB

[76] Inventors: Elaine Bernard, 5625 Summer Way, #303, Culver City, Calif. 90230; Arlayn Ladson, 6555 LaMirada Ave., #14, West Hollywood, Calif. 90038

[21] Appl. No.: 932,050

[22] Filed: Sep. 17, 1997

[51] Int. Cl.[6] ..... A41B 13/10

[52] U.S. Cl. ..... 2/49.1; 2/48; 2/49.4; 2/51

[58] Field of Search ..... 2/46, 48, 49.1, 2/49.2, 49.3, 49.4, 49.5, 50, 51, 52, 174, 105, 106, 75, 80, 83, 104, 912, 913, 914, 915, 916, 918, 920; 428/40, 79; 450/81

[56] References Cited

U.S. PATENT DOCUMENTS

| | | | |
|---|---|---|---|
| 2,492,599 | 12/1949 | Smith | 2/49.1 |
| 2,763,867 | 9/1956 | Chagnon | 2/49.2 |
| 3,329,969 | 7/1967 | Farber et al. | 2/49.1 |
| 3,332,547 | 7/1967 | Rowe et al. | 2/50 |
| 3,857,116 | 12/1974 | Meeker | 2/49.5 |
| 3,871,027 | 3/1975 | Orr | 2/49.2 |
| 4,306,316 | 12/1981 | Klepfer | 2/48 |
| 4,660,226 | 4/1987 | Quilling et al. | 2/49.2 |
| 5,054,124 | 10/1991 | Darvas | 2/174 |

FOREIGN PATENT DOCUMENTS

| | | | |
|---|---|---|---|
| 1095397 | 12/1967 | United Kingdom | 2/49.1 |

*Primary Examiner*—Jeanette Chapman
*Attorney, Agent, or Firm*—Benman & Collins

[57] ABSTRACT

An improved bib design. The inventive bib is a place-on bib which is adapted to attach to an upper body garment. The inventive bib includes a first layer of absorbent material having a body portion and two upwardly extending flaps defining a U-shaped opening therebetween. A top edge of each flap rest below, at or on the shoulders of a wearer when the bib is placed on the upper body garment of the wearer. A second layer of water repellent material is disposed on a rear surface of the first layer. A third layer of adhesive material is at least partially disposed on a rear surface of the second layer. The adhesive material allows the bib to rest below at or over the shoulders of the user allowing for an ease of removal and a safe use of same.

2 Claims, 3 Drawing Sheets

10′

20
16′
18
24
26
22
18

PLACE-ON BIB

BACKGROUND OF THE INVENTION

1. Field of the Invention

The present invention relates to articles of clothing. More specifically, the present invention relates to clothing that is particularly adapted for everyone (i.e., infants and adults).

2. Description of the Related Art

There are numerous shortcoming associated with conventional bib designs. The following references are illustrative of the state of the art in bib design: U.S. Pat. No. 5,054,124 issued Oct. 8, 1991, to Darvas; U.S. Pat. No. 4,660,226 issued Apr. 28, 1987 to Quilling et al.; U.S. Pat. No. 3,871,027 issued Mar. 18, 1975 to Orr; U.S. Pat. No. 3,857,116 issued Dec. 31, 1974 to Meeker; U.S. Pat. No. 3,332,547 issued Jul. 25, 1967 to Rowe et al.; U.S. Pat. No. 3,329,969 issued Jul. 11, 1967 to Farber et al.; U.S. Pat. No. 2,763,867 issued Sept. 25, 1956 to Chagnon; U.S. Pat. No. 2,492,599 issued Dec. 27, 1949 to Smith; and British Patent No. 1,095,397 issued Dec. 20, 1976.

Conventional bibs for children are small, U-shaped articles of cloth which include a string or strap at the upper ends thereof. The strap is affixed (by tying, velcro or snaps) around the infants neck to secure the bib in place. There are numerous shortcomings associated with this design.

First, it is often difficult and cumbersome to secure the bib in place. The child's head must be tilted forward while the straps are wrapped around the neck and affixed in back. The same procedure must be followed for removal of same. This seemingly easy and straightforward procedure is further complicated by the fact that the mother or attendant must often also hold the baby upright and/or carry other articles simultaneously.

Second, conventional bibs have limited absorbency and must be changed frequently. This is particularly true with respect to infants which often drool continuously. Hence, the difficulty associated with the application and removal of the bib is multiplied by the frequency of changes required throughout the day.

Third, the frequent bib changes place demands on the supply of bibs on hand. This may force more frequent trips to the laundry than would otherwise be required by someone already preoccupied with the care of one or more children.

Hence, a need exists in the art for improvements in the design and application of bibs for infants, small children and the like, special care facilities (i.e., convalescents, etc.).

SUMMARY OF THE INVENTION

The need in the art is addressed by the present invention which provides an improved bib design. The inventive bib is a place-on bib which is adapted to attach to an upper body garment. The inventive bib includes a first layer (which may include additional layers bonded thereto) of soft and durable absorbent material, which may be fire resistant, having a body portion and two upwardly extending flaps defining a U-shaped opening therebetween. A top edge of each flap rest below, at or on the shoulders of a wearer when the bib is placed on the upper body garment of the wearer. A second layer of water repellent material is disposed on a rear surface of the first layer. A third layer of adhesive material is at least partially disposed on a rear surface of the second layer.

The adhesive material allows the bib to rest below, at or on the shoulders with the semi-circle under wearer's neck allowing for an ease of removal and a safe use of same.

The present invention provides for sanitation (through super absorbent material which may be disposable) and it also provides for safety because it does not affix around the neck, thus not posing strangulation risks. The bib may have designs, colors, scents, prints and may be perforated or stacked in packages and may be disposed of after use.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
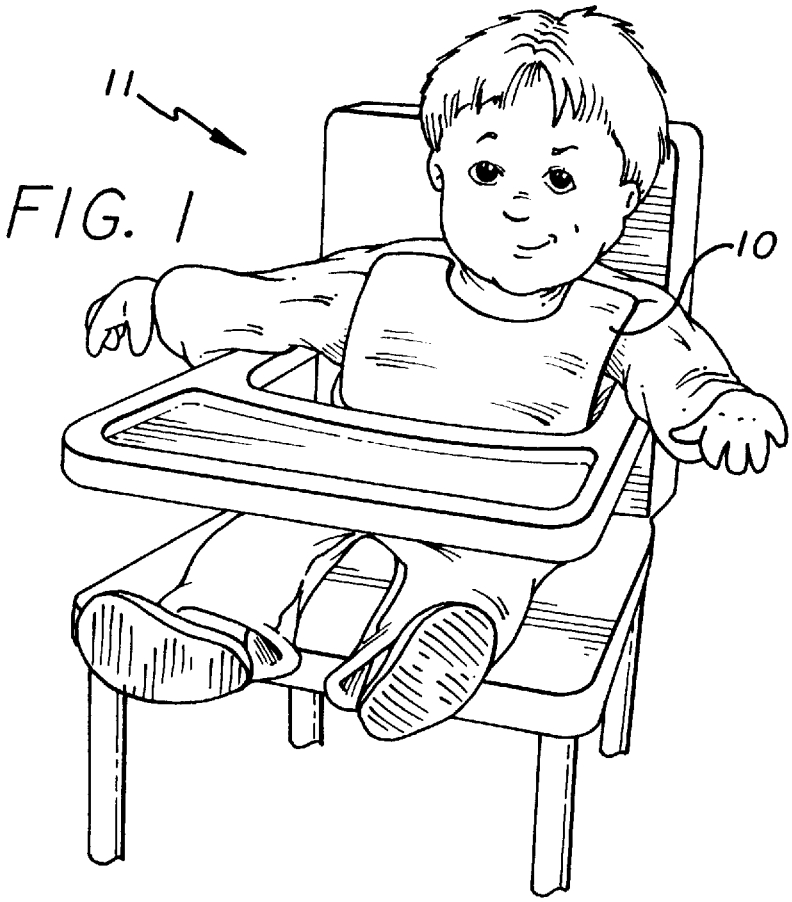
FIG. 1 is a perspective view of the place-on bib of the present invention.
Figure 2:
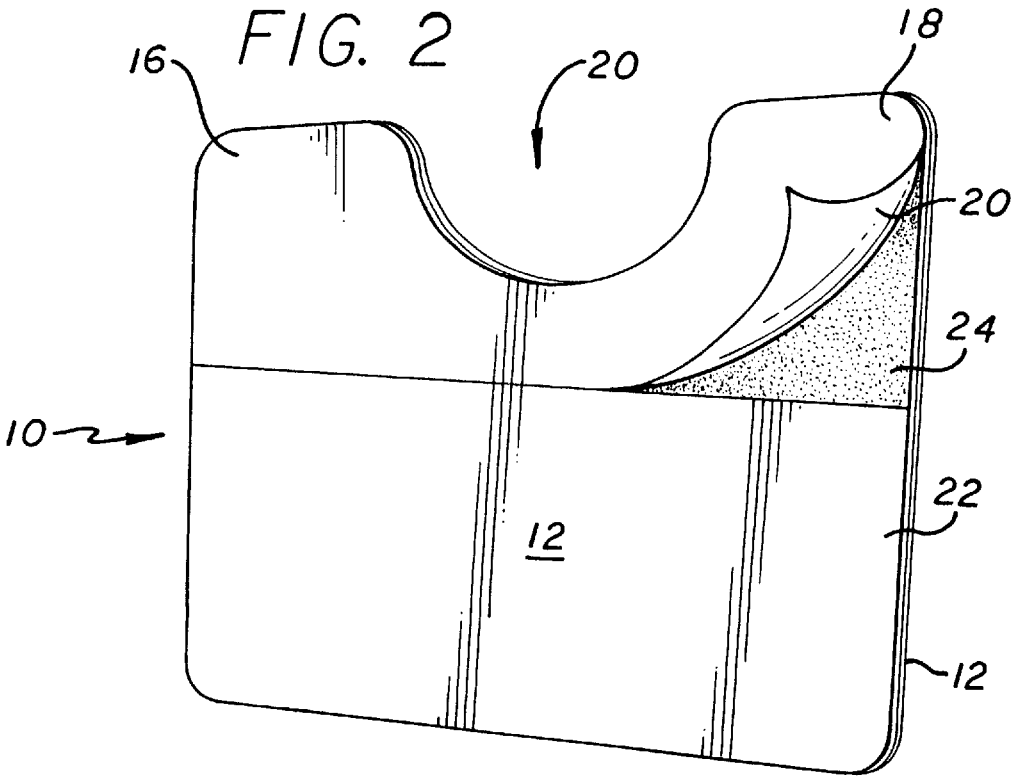
FIG. 2 is a perspective rear view of the place-on bib of the present invention.
Figure 3:
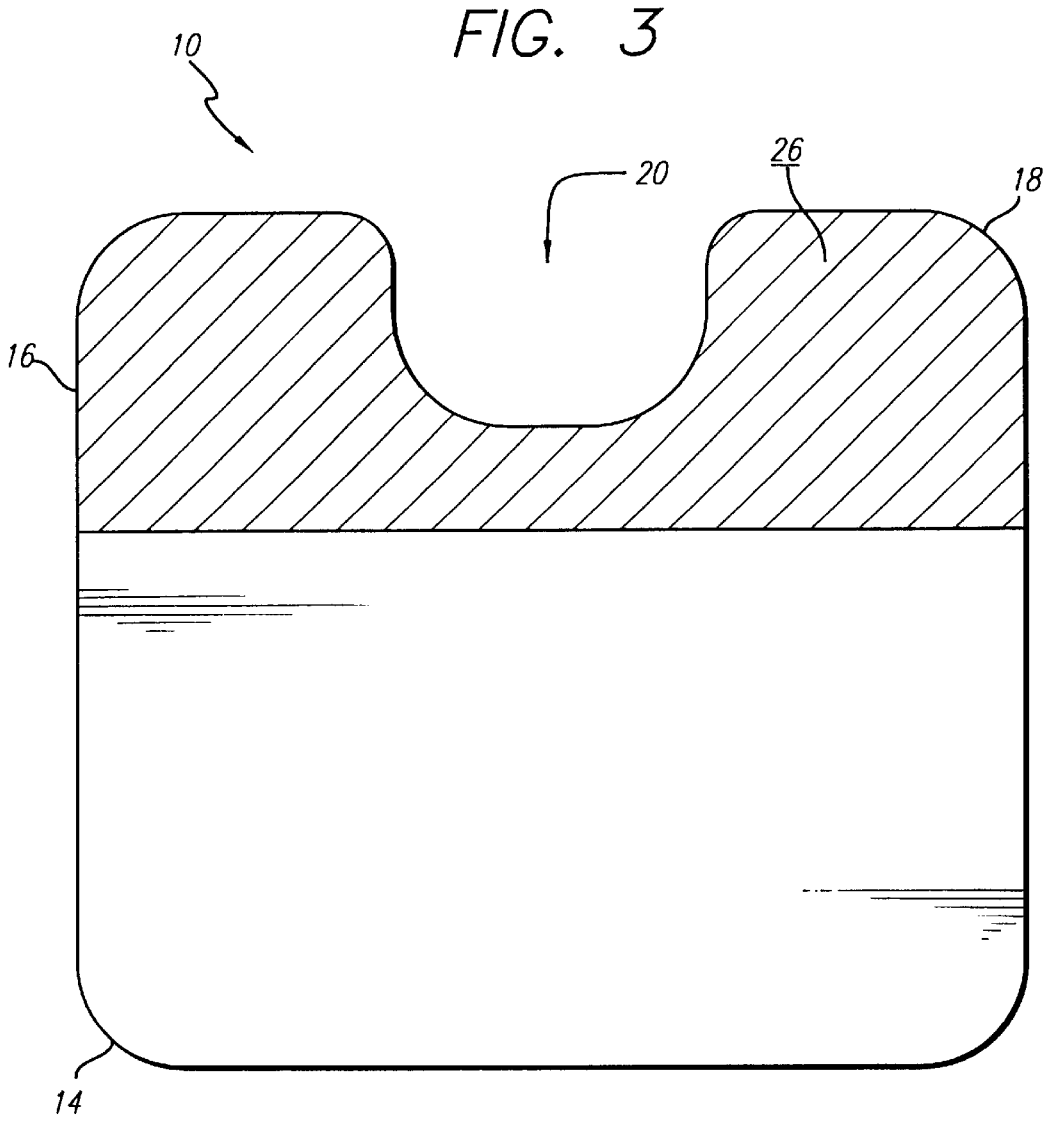
FIG. 3 is a rear view of the place-on bib of the present invention.
Figure 4:
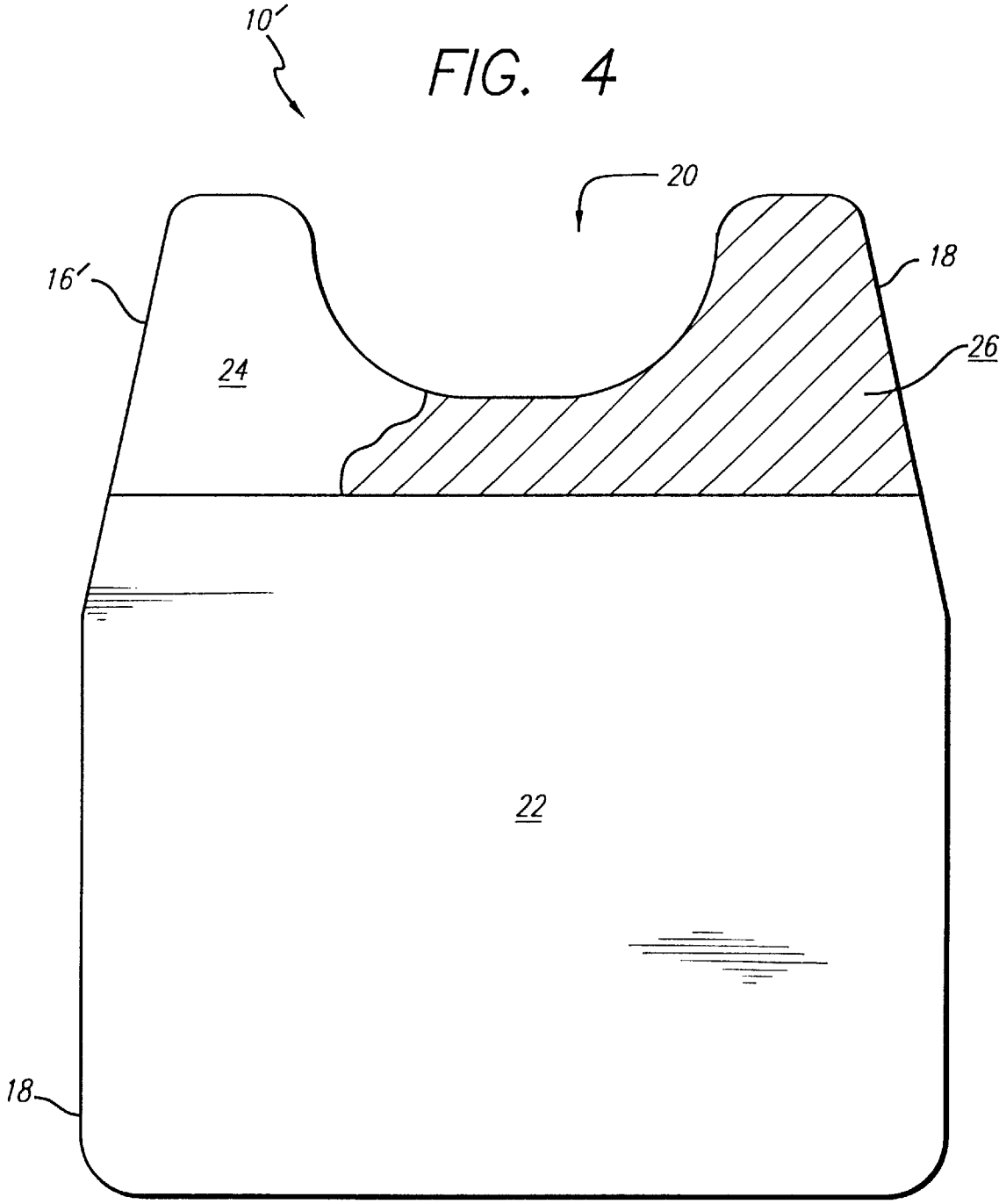
FIG. 4 is a rear view of an alternative embodiment of the place-on bib of the present invention.

FIG. 1 is a perspective view of the place-on bib of the present invention 10 shown on an infant 11. FIG. 2 is a perspective rear view of the place-on bib of the present invention. FIG. 3 is a rear view of the place-on bib of the present invention. FIG. 4 is a rear view of an alternative embodiment of the place-on bib of the present invention.

As shown in FIGS. 1–4, the inventive bib 10 includes a mat 12. The mat 12 may be made of cloth, paper, plastic or other suitably absorbent material as will be appreciated by those of ordinary skill in the art. The paper and plastic constructions facilitate disposable implementations. In the illustrative embodiment, the mat 12 is a water absorbent, soft tissue type paper such as the dry-up towels currently manufactured and sold by Kimberly-Clark, James River Corporation and any other comparable paper company.

The mat 12 includes a lower body portion 14 and first and second flaps 16 and 18 integral therewith. The invention is not limited to the shape of the mat and flaps as shown in the drawing. The flaps 16 and 18 provide a U-shaped opening 20 for the neck of the wearer. The length of the flaps 16 and 18 is such that the flaps do not pass over the shoulder and around the neck as is common with prior designs. If the flaps extend over the top of the shoulders, the bib is not appropriately sized. Hence, in the illustrative embodiment, the flaps are short so that the opening is shallow, on the order of 20 percent of the length of the bib 10. The bib 10 is designed so that for each individual a bib of an appropriate size sits on the chest and is retained in position by a layer of adhesive disposed on the rear surface of the bib as discussed more fully below.

As depicted in FIG. 2, the rear surface of the mat 12 is lined with a water repellent material such as a thick layer 22 of plastic (polyethylene) film.

As depicted in the rear view of FIGS. 3 and 4, a continuous pressure sensitive adhesive is disposed on the upper third of the rear surface of the bib 10. The adhesive layer 24 may be applied to the water repellent layer 22 as a double coated polyester Fas Tape 8306 as sold by Avery Dennison. The adhesive layer 24 is covered with a layer of relief paper 26 which serves as a backing and is shown partially removed in the perspective rear view of FIG. 2. The adhesive is chosen to attach to an upper body garment of a wearer.

FIG. 4 shows a rear view of an alternative embodiment 10' of the bib of the present invention. The bib 10' has flaps 16' and 18' which are tapered as the flaps extend upwardly from the body section 14. The taper allows for more arm movement by the wearer without interfering with the performance of the bib. This embodiment is therefor more suitable for wear by adults in dental and other applications such as hair cutting and etc. In the embodiment of FIG. 4, part of the adhesive backing 26 is removed to reveal the adhesive layer 24.

In any event, in operation, the adhesive backing 26 is removed and an appropriately sized bib 10 or 10' is placed on the chest area of the wearer.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A place-on bib for use with an upper body garment, the place-on bib comprising:

a first layer of absorbent material having a body portion and two upwardly extending flaps defining a U-shaped opening therebetween whereby a top edge of each flap rests below a top of a shoulder of a wearer when said bib is placed on said upper body garment;

a second layer of water repellent material disposed on a rear surface of said first layer; and a third layer of pressure sensitive adheive continuously disposed on an upper one third area of a rear surface of the second layer of water repellant material.

2. The invention of claim 1 wherein said flaps are tapered.

* * * * *